US005256327A

United States Patent [19]

Allen et al.

[11] Patent Number: 5,256,327

[45] Date of Patent: Oct. 26, 1993

[54] METHOD OF PREPARING A SEQUESTERING AGENT FOR A NON-PHOSPHATE CLEANING COMPOSITION

[75] Inventors: Rebecca Allen, Pleasanton; Milton Palmer, Castro Valley, both of Calif.

[73] Assignee: Shaklee Corporation, San Francisco, Calif.

[21] Appl. No.: 826,450

[22] Filed: Jan. 27, 1992

Related U.S. Application Data

[62] Division of Ser. No. 738,822, Aug. 1, 1991.

[51] Int. Cl.[5] ..... C11D 3/10; C11D 1/66; C11D 3/18

[52] U.S. Cl. ..... 252/90; 252/174.14; 252/174.19; 252/174.18; 252/174; 134/22.19; 134/26; 134/28

[58] Field of Search ..... 252/174.14, 174.24, 252/174.19, 174.18, 90, 174; 134/22.19, 26, 28

[56] References Cited

U.S. PATENT DOCUMENTS

| | | | |
|---|---|---|---|
| 3,825,498 | 7/1974 | Altenschopfer et al. | 252/99 |
| 3,941,710 | 3/1976 | Gilbert et al. | 252/99 |
| 3,968,046 | 7/1976 | Smeets | 252/99 |
| 4,009,114 | 2/1977 | Yurko | 252/109 |
| 4,028,262 | 6/1977 | Cheng | 252/89 |
| 4,049,585 | 9/1977 | Heckert | 252/531 |
| 4,127,496 | 11/1978 | Stokes | 252/102 |
| 4,162,987 | 7/1979 | Maguire, Jr. et al. | 252/135 |
| 4,203,858 | 5/1980 | Chakrabarti | 252/135 |
| 4,244,832 | 1/1981 | Kaneko | 252/99 |
| 4,539,144 | 9/1985 | de Ridder et al. | 252/95 |
| 4,568,476 | 2/1986 | Kielman | 252/95 |
| 4,576,727 | 3/1986 | Browne | 252/90 |
| 4,597,886 | 7/1986 | Goedhart et al. | 252/95 |
| 4,692,260 | 9/1987 | Sung et al. | 252/99 |
| 4,753,748 | 6/1988 | Laitem et al. | 232/99 |
| 4,797,223 | 1/1989 | Amick et al. | 252/174.23 |
| 4,820,440 | 4/1989 | Hemm et al. | 252/135 |
| 4,824,593 | 4/1989 | Appel et al. | 252/90 |
| 4,933,101 | 6/1990 | Cilley | 252/99 |
| 5,118,439 | 2/1992 | Urfer et al. | 252/174.17 |

FOREIGN PATENT DOCUMENTS

| | | | |
|---|---|---|---|
| 0949843 | 6/1974 | Canada | 252/174.19 |
| 0419036 | 3/1991 | European Pat. Off. | 252/174.14 |
| 2025450 | 1/1980 | United Kingdom | 252/174.19 |

*Primary Examiner*—Paul Lieberman
*Assistant Examiner*—Keey A. Fries
*Attorney, Agent, or Firm*—Klarquist, Sparkman, Campbell, Leigh and Whinston

[57] ABSTRACT

A substantially dry, water-soluble composition is provided that is useful for hard surface cleaning in the presence of water without the necessity of phosphate builders. The composition comprises a sequestering agent formed by intimately admixed particles of a carbonate salt and a hydrocarboxylic acid salt, such as citrate, where the salts have a common alkaline metal cation. This sequestering agent is preferably formed during the composition preparation. The composition further includes an anti-redeposition agent, an alkaline metal silicate, a non-ionic surfactant, and an enzyme system.

6 Claims, No Drawings

METHOD OF PREPARING A SEQUESTERING AGENT FOR A NON-PHOSPHATE CLEANING COMPOSITION

This is a division of application Ser. No. 07/738,822, filed Aug. 1, 1991.

FIELD OF THE INVENTION

The present invention generally relates to automatic dishwashing compositions, and more particularly to a non-phosphate dishwashing composition where a citrate salt is preferably generated during the composition preparation and the composition provides cleaning performance equivalent to phosphate containing dishwashing compositions.

BACKGROUND OF THE INVENTION

Beginning in the 1950s and early 1960s, the foaming of streams, rivers, and some lakes was a condition widely noted as approaching an ecological crisis in the United States. Today the Environmental Protection Agency estimates that 25% of the nation's lakes are polluted and another 20% are threatened. The Senate Majority Leader has recently announced he plans to introduce legislation aimed at increasing the protection of fresh water lakes, including the elimination of the use of phosphates in detergents. Lakes become cloudy when excessive phosphate pollution from detergents and agriculture boosts the growth of algae. Although phosphates account for only a small percentage of phosphorous emissions overall in the United States, detergent phosphorous is a much more significant percentage in some highly populated areas.

The first bans on phosphates in detergent occurred in the Great Lakes region in the 970s when Lake Erie, in particular, was choked with pollution. Most recently, Pennsylvania has been acting to regulate phosphates.

The best selling book 50 *Simple Things You Can Do To Save The Earth* recommends the use of a low-phosphate or phosphate-free detergent and mentions that liquid detergents are generally phosphate-free. In the United States, bans on the use of sodium tripolyphosphate (STPP) have boosted sales of phosphate-free detergents to a significant share of the domestic market; however, phosphate continues to be the leading "builder" in U.S. and European detergent production.

Detergent builders are substances that increase the effectiveness of surfactants and typically act as water softeners and as sequestering and buffering agents. Because phosphates are excellent, inexpensive builders, replacing phosphates has posed difficulties, particularly for certain applications and for dry cleaning compositions. For example, although there are a number of patents that have issued since the later 1970s describing various non-phosphate automatic dishwasher detergent compositions, commercial acceptability has not followed, due perhaps to inadequate cleaning performances provided by these alternate compositions. Also, increased production expense and stability problems for granulated, nonphosphate compositions have been encountered.

U.S. Pat. Nos. 3,825,498, issued Jul. 23, 1974, 4,203,858, issued May 20, 1980, and 4,539,144, issued Sep. 3, 1985, describe dishwashing compositions that include specific polymers or polymers in particular amounts as replacements for phosphates. Thus, the U.S. Pat. No. 35 3,825,498 (inventors Altenschopfer et al.) describes a dishwashing detergent composition that includes 5-90% by weight of a solid crosslinked or noncrosslinked hydroxycarboxylic acid polymer and that is said to have a particularly strong cleaning effect against protein containing burnt scraps of food. U.S. Pat. No. 4,203,858 (inventor Chakrabarti) describes a dishwashing composition that includes a polyelectrolyte salt with a molecular weight between about 500-4,000 and that is said to be phosphate-free and low foaming. U.S. Pat. No. 4,539,144 (inventors de Ridder et al.) describes a dishwashing composition with a small amount of hydrolyzed polymaleic anhydride having an average molecular weight of about 2500, which is said to have improved non-foaming, non-spotting, or non-streaking properties.

U.S. Pat. Nos. 3,941,710, issued Mar. 2, 1976, 4,049,585, issued Sep. 20, 1977, and 4,127,496, issued Nov. 28, 1978, all describe low or antifoaming surface active agents, typically non-ionic for inclusion in cleaning compositions. Thus, U.S. Pat. No. 3,941,710 (inventors Gilbert et al.) describes use of a specific type of anionic surfactant (polyether carboxylate) with a non-ionic surface active agent. These surfactants are described for use with an antifoaming agent of a fatty acid phosphate or certain fatty acids and together are said to permit the reduction of phosphate content to not more than 15 percent. U.S. Pat. No. 4,049,585 (inventor Heckert) discloses use of vicinal non-terminal disulfates as low sudsing surfactants useful in automatic dishwashing compositions containing a low amount of conventional sequestering builders such as phosphates. U.S. Pat. No. 4,127,496 (inventor Stokes) describes uses of non-ionic detergents with either tetrasodium ethylenediamine tetracetate or nitrilotriacetic acid. However, the latter, while an effective builder, has been implicated in possible carcinogenicity.

U.S. Pat. No. 4,162,987, issued Jul. 31, 1979, inventors Maguire, Jr. et al., describes automatic dishwashing compositions with a binary enzyme system comprising a proteolytic enzyme and an amylolytic enzyme. Polyphosphates are suggested for inclusion as builders in the compositions.

U.S. Pat. No. 4,576,727, issued Mar. 18, 1986, inventor Browne, discloses phosphate-free detergent compositions for textile washing and notes that replacements of the customary tripolyphosphate builders have been unsatisfactory for one reason or another, with replacement by sodium citrate requiring such a large amount, particularly for high temperature washing, that the costs would be unacceptable.

SUMMARY OF THE INVENTION

The present invention provides a substantially dry, water-soluble composition that is useful for hard surface cleaning in the presence of water without the necessity of including phosphate builders, but which composition provides comparable cleaning performance to phosphate-built compositions. A particularly preferred embodiment is useful for automatic dishwashing and comprises intimately admixed particles of a carbonate salt and a citrate where the salts have a common alkaline metal cation, an anti-redeposition agent, an alkaline metal silicate, a non-ionic surfactant, and an enzyme system. The inventive composition has a pH of between about 9 to about 12 when dissolved in water during use.

The preferred citrate of the sequestering agent is in an amount up to about 31% of the total composition and is formed from the carbonate salt during preparation of the composition, which reduces the overall cost of the product.

DETAILED DESCRIPTION OF PREFERRED EMBODIMENTS

The role of builder in cleaning compositions of this invention is primarily filled by a hydroxycarboxylic acid salt which functions both as builder and as sequestering agent. A particularly preferred hydroxycarboxylic acid salt is a salt of citric acid having the structure:

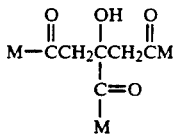

wherein M is an alkaline metal cation, preferably sodium or potassium. In the alkaline metal salt form, the citrate is stable in air and, by control of other critical parameters for the inventive composition, allows greater than about 12 month shelf stability for cleaning composition embodiments of the invention.

The neutralization reaction of citric acid with carbonate proceeds by the equation:

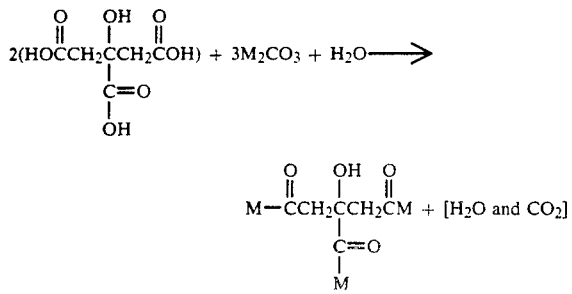

However, the prior art conversion of citric acid to citrate by neutralization in solution has lead to unacceptably high costs for formulating cleaning compositions. In one aspect of the present invention, dry citric acid and dry carbonate, such as sodium or potassium carbonate, are admixed. An amount of water, preferably limited to less than about or about 5 wt. % of the dry blend, is added and the thus moistened admixture further mixed well. An exothermic acid/base neutralization reaction commences with generation of carbon dioxide and with the citric acid being converted to citrate. Because compositions of the invention also include carbonate as a builder (that is, a co-builder with the citrate) it is preferred to admix all, or most, of the carbonate to be included in the formulation (preferably between about 5 wt. % to about 50 wt. % before the reaction and about 1 wt. % to about 34 wt. % after the reaction) during this neutralization step so that the excess carbonate helps drive the reaction and ensures that all, or substantially all, the citric acid is converted to citrate. A microscopic examination of the reaction products can be used to reveal the absence of citric acid crystals at the conclusion of the reaction.

The amount of water added during the neutralization is preferably limited so as to be just sufficient for neutralization to occur at interfaces of the otherwise substantially dry materials. The use of substantially dry neutralization agent, such as sodium carbonate, reduces the water content and thus the amount of drying. This increases ease of processing. However, there must be sufficient water to accommodate mass transfer considerations in order for the neutralization to efficiently proceed.

The amount of citric acid in preparing inventive compositions is preferably between about 5 wt. % to about 20 wt. % which results, after reaction, in citrate in an amount from about 7.5 wt. % to about 31 wt. %.

Due to the particularly preferred in situ preparation of citrate, intimately admixed particles of carbonate salt and citrate having a common alkaline metal cation will be obtained for use in formulating dry cleaning compositions with suitable surfactant blends for hard surface cleaning.

Suitable surfactant blends of the invention include a non-ionic surfactant, preferably with low foaming properties for automatic dishwashing applications, an anti-redeposition agent, preferably one that also functions to chelate calcium ions, an alkali metal silicate, and an enzyme system having enzymatic activity at alkaline pH. Each of these components will now be more specifically described.

Non-Ionic Surfactant

Preferred non-ionic surfactants, or surface active agents, are ethylene oxide or propylene oxide condensates. Exemplative are the reaction products of benzyl chloride and ethoxylated alkyl phenol and others as described by U.S. Pat. No. 4,127,496. Among the many non-ionic surfactants that are useful in compositions of the invention are those commercially available under the trade name "Polytergent SLF-18" (available from Olin Chemical). Compositions of the invention preferably include non-ionic surfactant in amounts between about 1 wt. % to about 10 wt. %.

Anti-Redeposition Agent

A preferred anti-redeposition agent also functions to chelate calcium ions or to inhibit calcium crystal growth. During the automatic dishwashing cycle, there is a tendency for calcium salts to precipitate, normally as calcium carbonate crystals. This crystal growth causes spotting and filming on glassware. Phosphate salts can be used to inhibit calcium crystal growth, but where a phosphate-free composition is being prepared, it is particularly important to prevent calcium crystal growth and to sequester calcium (and magnesium) ions, to remove such ions from the soils being cleaned to make the soils more soluble, and to maintain such soils in solution for removal.

A preferred anti-redeposition agent with the desired chelating and/or calcium crystal growth inhibiting properties is a polyelectrolyte salt, preferably a polyacrylyte or methacrylyte salt having a molecular weight between about 500 to about 10,000. Such a polyelectrolyte must be water soluble, and a number of suitable anti-redeposition agents are commercially available. Such components include, for example Sokalan polyacrylate (available from BASF) and Good-Rite polyacrylate (available from Goodrich). The water soluble polymeric component is preferably included in the inventive compositions in a range between about 1 wt. % to about 8 wt. %.

Alkali Metal Silicate

Silicate components prevent etching of aluminum and glassware over repeated wash cycles. Sodium silicate is a preferred silicate component and also functions as an alkaline agent to saponify and agglomerate soils. Since foods tend to be acidic, alkalinity of the inventive composition is preferably between about 9 to about 12, most preferably about 10 to 10.5. Thus, the silicate and the earlier described carbonate together function to raise the pH of inventive compositions.

While sodium silicate is a preferred silicate component, potassium silicate and metasilicates are also useful. The silicate component is preferably in an amount from about 2 wt. % to about 50 wt. % of the inventive compositions.

Enzyme System

A suitable enzyme system of the present invention includes a proteolytic enzyme and an amylolytic enzyme, both of which must be active within the highly alkaline range of the compositions. Enzymes aid the removal of soils, and suitable enzyme systems include the proteolytic and amylolytic, alkaline resistant enzymes described by U.S. Pat. No. 4,162,987. Because, however, the enzymes could be degraded or inactivated during the in situ reaction between citric acid and carbonate preferred for practice of this invention, the enzyme should be added after the acid/base reaction has taken place and after any agglomeration step. The actual amount of enzyme system added to the compositions will depend, of course, upon the specific activity of the enzymes. Where one mixes the two commercially available enzymes from Novo Nordisk Bioindustrials (protease-Esperase 6.0T and AmalaseTermamyl 60T), then typical enzyme amounts will be about equal parts of amylase and protease in a combined range of about 0.4 wt. % to about 4 wt. % of the total composition.

Optional Components

Where desired, additional builders, sequestering agents, dyes, fragrances, oxidizing agents, and/or chelating agents may be optionally included. For example, particularly preferred embodiments of the invention include minor amounts of tetrasodium ethylenediamine tetracetate in amounts up to about 5 wt. %. Excipients, such as alkaline metal sulfates and/or chlorides in amounts up to about 50 wt. %, are desirable. Where an oxidizing agent is desired to assist in preventing staining on glassware and china and film buildup (and which may also provide some sterilization, although the primarily sterilizing function is achieved by the elevated water temperature during the washing cycle of automatic dishwashers), then such may be included in amounts up to about 40 wt. % of, e.g., a percarbonate (of which about 14% is usually A.O.). Selected oxidizing agents must be stable in the highly alkaline solutions of the inventive compositions, not adversely affect the enzymes, and should be added after the acid/base in situ reaction to citrate. A particularly suitable such oxidizing agent is sodium percarbonate.

Other optional components may also be included, so long as they are compatible with the inventive compositions as described. Free water of the final, shelf-ready compositions should not exceed 6 wt. %.

Compositions of the invention take the form of dry granules that are preferably agglomerated to reduce dust and to standardize particles to a preferred particle range size. When agglomerated, then the silicate component or the polymer component may be used as an agglomerate agent by dissolving in water and spraying on the admixed blend. The preferred particle size range is between about 12 mesh to about 50 mesh.

A particularly preferred embodiment of the composition has the following formulation and forms a solution pH when dissolved of 10.5:

PARTICULARLY PREFERRED EMBODIMENT

| | Used in Preparation (wt. %) | Final Formulation (wt. %) |
|---|---|---|
| Sodium citrate | 0 | 15 |
| Citric Acid | 9.8 | 0 |
| Sodium carbonate | 18.1 | 10 |
| Polymer (Sokalan polyacrylate, MW 8,000) | | 2 |
| Sodium silicate (15% of 47% solution) | | 7 |
| Non-ionic surfactant (polytergent SLF.18) | | 2 |
| Amalase (Termamyl 60T) | | 0.5 |
| Protease (Esperase 6.0T) | | 0.5 |
| $Na_4$ EDTA | | 0.5 |
| NaCl | 11 | |
| $Na_2SO_4$ | | 44.2 |
| Free water | | 3.5 |

Example 1 describes the preparation of this particularly preferred embodiment, which was then used in spot and film performance testing as described by Examples 2 and 3.

EXAMPLE 1

In a Marion or other type of suitable mixer the dry citric acid and sodium carbonate were mixed together. Excipients such as sodium sulfate and other non-reactive ingredients were also added at this time, but can be added during the next step or after the reaction is complete.

Water was added to the dry blend and mixed well. An exothermic acid/base reaction began to take place. Heat and carbon dioxide were generated, and the citric acid was converted to sodium citrate. A microscopic examination of the reaction products revealed the absence of citric acid crystals. This reaction took place in the initial mixer. (All or part of the citric acid may be added as a solution so that the addition of water may not be required for the reaction to take place.)

The remaining formulation ingredients, except enzymes, were added next. (If dry blending is selected, then all the ingredients are mixed well to homogenize.) If the product is to be agglomerated, a suitable agglomerant, either silicate, or polymer will be held back from earlier steps, dissolved in water, and sprayed on the mixture as required. Suitable apparatus for agglomeration include Rotary Drum (O'Brien), Fluid Bed (Shuggi) or Twin Shell (P.K.) type mixers. After drying the mixture to <6% free water, the rest of the ingredients were added and the formulation was well mixed.

EXAMPLE 2

The particularly preferred embodiment, such as described by Example 1, was compared to four commerciallyavailable, phosphate-containing dishwashing compositions. The test protocol was whereby clear glass tumblers were soiled with margarine and milk. The soiled tumblers were then washed in automatic dishwashers for five cycles with the recommended dosages of either one of the four commercially available, phosphate-containing dishwashing compositions or with the inventive composition (at 10 ml/cup or 20 ml/cup recommended dosage, depending on water hardness). A panel of six persons then graded the washed tumblers on a scale of "4" (meaning no spots or filming) to "0" (meaning totally covered with spots and films). The six scores were averaged for each composition.

With water having a hardness of 150 ppm, the test panel following the just prescribed protocol rated the five compositions as is shown by the data in Table 1. The test panel did not know which composition was being rated.

TABLE 1

| | Average Spot/Film Score |
|---|---|
| Prior Art Comp. 1 (40 mL/cup) | 3.39 |
| Prior Art Comp. 2 (40 mL/cup) | 3.38 |
| Prior Art Comp. 3 (40 mL/cup) | 3.46 |
| Prior Art Comp. 4 (10 mL/cup) | 2.19 |
| Inventive Comp. (10 mL/cup) | 3.34 |

As can be seen from the data of Table 1, the inventive composition provided comparable results to three of the phosphate-containingcommercially available compositions (and superior performance to a fourth), although the inventive composition contained no phosphates while all four of the commercially available comparative compositions did contain phosphates.

EXAMPLE 3

A protocol analogous to that described by Example 2 was followed except that water having an hardness of 300 ppm was used. The same four commercially available comparative compositions were used (ranging in total phosphate from about 6.1wt. % to about 8.7 wt. %), except that the prior art composition 4 was used at the increased recommended dosage of 20 ml/cup and the inventive composition was likewise used at the increased recommended dosage of 20 ml/cup. Table 2 sets out the results.

TABLE 2

| | Average Spot/Film Score |
|---|---|
| Prior Art Comp. 1 (40 mL/cup) | 2.98 |
| Prior Art Comp. 2 (40 mL/cup) | 3.16 |
| Prior Art Comp. 3 (40 mL/cup) | 3.45 |
| Prior Art Comp. 4 (20 mL/cup) | 0.68 |
| Inventive Comp. (20 mL/cup) | 3.35 |

As was described for Example 2, the inventive composition again provided substantially comparable results to three of the commercially available compositions (and considerably superior to the fourth) despite the wash water being relatively hard and despite the absence of phosphates in the inventive composition.

It is to be understood that while the invention has been described above in conjunction with preferred specific embodiments, the description and examples are intended to illustrate and not limit the scope of the invention, which is defined by the scope of the appended claims.

It is claimed:

1. A method of preparing a sequestering agent, useful in formulating a substantially phosphate-free, granulated cleaning composition, the method comprising the steps:

(a) forming a reaction mass by intimately admixing dry particles of an alkali metal carbonate salt and dry particles of an hydroxycarboxylic acid, the carbonate salt being in a molar excess with respect to the hydroxycarboxylic acid;

(b) adding not greater than about 5 wt. % water to the admixture of step (a) and mixing the moistened reaction mass to convert the hydroxycarboxylic acid to an alkali metal hydroxycarboxylic acid salt; and (c) incorporating the reaction products of step (b) into a surfactant blend.

2. The method as in claim 1 wherein the surfactant blend includes:

a non-ionic surfactant in an amount sufficient to provide 1 wt. % to 10 wt. % of the non-ionic surfactant in the composition; and an anti-redeposition agent in an amount sufficient to provide 1 wt. % to 10 wt. % of the anti-redeposition agent in the composition.

3. The method as in claim 1 wherein the reaction products of step (b) consist essentially of intimately admixed particles of the carbonate salt and the hydroxycarboxylic acid salt, the salts having a common alkali metal cation.

4. The method as in claim 3 wherein the hydroxycarboxylic acid is citric.

5. A sequestering agent made according the process of claim 1.

6. A method of making a substantially dry, water soluble composition, useful for hard surface cleaning in the presence of water, the method comprising intimately admixing:

(a) a sequestering agent made by the process of claim 1, the sequestering agent including the alkali metal carbonate salt in an amount from about 1 wt. % to about 34 wt. % of the total composition, and the alkali metal hydroxycarboxylic acid salt in an amount from about 7.5 wt. % to about 31 wt. % of the total composition;

(b) from about 2 wt. % to about 50 wt. % of an alkali metal silicate; and (c) an enzyme system having enzymatic activity at alkali pH.

* * * * *